US010759028B2

(12) United States Patent
Funk

(10) Patent No.: US 10,759,028 B2
(45) Date of Patent: Sep. 1, 2020

(54) SQUARE TOOL HOLDER AND IMPACT WRENCH

(71) Applicant: Hilti Aktiengesellschaft, Schaan (LI)

(72) Inventor: Alexander Funk, Schwabmuenchen (DE)

(73) Assignee: Hilti Aktiengesellschaft, Schaan (LI)

( * ) Notice: Subject to any disclaimer, the term of this patent is extended or adjusted under 35 U.S.C. 154(b) by 174 days.

(21) Appl. No.: 15/746,595

(22) PCT Filed: Jul. 27, 2016

(86) PCT No.: PCT/EP2016/067857
§ 371 (c)(1),
(2) Date: Jan. 22, 2018

(87) PCT Pub. No.: WO2017/017121
PCT Pub. Date: Feb. 2, 2017

(65) Prior Publication Data

US 2018/0207774 A1 Jul. 26, 2018

(30) Foreign Application Priority Data

Jul. 27, 2015 (EP) ..... 15178426

(51) Int. Cl.
*B25B 23/00* (2006.01)
*B25B 21/02* (2006.01)

(52) U.S. Cl.
CPC ..... *B25B 23/0035* (2013.01); *B25B 21/026* (2013.01)

(58) Field of Classification Search
CPC ... B25B 21/02; B25B 21/026; B25B 23/0035; F16B 7/042
See application file for complete search history.

(56) References Cited

U.S. PATENT DOCUMENTS 2,576,298 A * 11/1951 Kessler ..... F16B 2/248 403/247
2,721,090 A * 10/1955 Kaman ..... B25B 23/0035 403/328

(Continued)

FOREIGN PATENT DOCUMENTS

WO WO2014/154400 10/2014

OTHER PUBLICATIONS

Search Report of PCT/EP2016/067857, dated Nov. 25, 2016, 3 pages.

*Primary Examiner* — Andrew M Tecco
(74) *Attorney, Agent, or Firm* — Davidson, Davidson & Kappel, LLC

(57) ABSTRACT

A square tool holder (10) for an impact wrench is provided, including an anvil (1), on which a drive square (2) is situated for accommodating a tool, in particular an impact wrench socket, and including a safety bolt (3) for securing the accommodated tool, the safety bolt (3) being spring-mounted in the drive square (2) in such a way that the safety bolt is movable perpendicularly to the axis of rotation (D) of the anvil (1), the safety bolt (3) having a rounded, preferably hemispherical surface (3'), which protrudes from a holding surface (2') of the drive square (2) in a state of spring-extension (AZ) of the safety bolt (3) and is at least partially countersunk in the holding surface (2') in a state of spring-compression of the safety bolt (3), the safety bolt (3) being secured against falling out by at least one safety pin (4, 4') situated in the drive square (2).

22 Claims, 2 Drawing Sheets

A-A

(56) References Cited

U.S. PATENT DOCUMENTS

| | | | | | |
|---|---|---|---|---|---|
| 3,118,696 | A * | 1/1964 | Valter | B25B 23/0035 | 403/328 |
| 3,752,514 | A * | 8/1973 | Schoeps | B25B 23/0035 | 403/328 |
| 4,962,682 | A * | 10/1990 | Rose | B25B 23/0021 | 81/177.1 |
| 5,255,993 | A * | 10/1993 | Kovacs | F16B 7/042 | 403/316 |
| 6,672,183 | B2 * | 1/2004 | Johnson | B25B 23/0035 | 81/177.85 |
| 9,669,526 | B2 * | 6/2017 | Ely | B25B 23/0035 | |
| 2002/0152848 | A1 * | 10/2002 | Johnson | B25B 23/0035 | 81/465 |
| 2006/0118316 | A1 * | 6/2006 | Clark, Jr. | B25B 21/02 | 173/128 |
| 2012/0321374 | A1 * | 12/2012 | Ray | B25B 23/0014 | 403/111 |
| 2015/0190909 | A1 * | 7/2015 | Ely | B25B 23/0035 | 173/93 |

* cited by examiner

A-A

SQUARE TOOL HOLDER AND IMPACT WRENCH

The present invention relates to a square tool holder for an impact wrench, including an anvil, on which a drive square is situated for accommodating a tool, in particular an impact wrench socket. The square tool holder includes a safety bolt for securing the accommodated tool.

BACKGROUND

Square tool holders for impact wrenches, in particular for tangential impact wrenches, are generally known from the prior art. They are used to accommodate tools, for example impact wrench sockets or the like. A tool accommodated on the drive square is fixed in position with the aid of the safety bolt.

SUMMARY OF THE INVENTION

It is an object of the present invention to provide a square tool holder which is particularly easy to handle and stable at the same time.

With regard to the square tool holder, the present invention provides that the safety bolt is spring-mounted in the drive square, movable perpendicularly to the rotation axis of the anvil, the safety bolt having a rounded, preferably hemispherical surface, which protrudes from a holding surface of the drive square in a state of spring-extension of the safety bolt and is at least partially countersunk in the holding surface in a state of spring-compression of the safety bolt. The safety bolt is secured against falling out by at least one safety pin situated in the drive square.

The present invention includes the finding that safety bolts in previously known square tool holders according to the prior art are typically difficult to replace or are awkward to repair in the case of wear. It was also recognized as disadvantageous that it is typically not possible to mount and remove impact wrench sockets in square tool holders according to the prior art. Conversely, the safety bolt of the square tool holder according to the present invention is spring-mounted, the safety bolt having a rounded, preferably hemispherical surface. A tool-free and thus easy mounting and removal of an impact wrench socket thus becomes possible.

The square tool holder according to the present invention also has the advantage that a weakening of the square cross section due to various bores and blind holes, as is typical in square tool holders according to the prior art, is avoidable in that the safety bolt is secured against falling out by at least one safety pin situated in the drive square. The square tool holder according to the present invention is thus also particularly stable.

In one preferred embodiment, the safety pin extends in parallel to the rotation axis of the anvil. The safety pin is preferably situated in a blind hole, which extends from an end face of the drive square in parallel to the rotation axis of the anvil. An arrangement of the safety pin and/or the blind hole in parallel to the rotation axis, i.e. to the effective axis of the anvil and thus longitudinally to the tensile and compression stresses, means that the anvil or the drive square is much less susceptible to breaking.

The diameter of the safety pin is particularly preferably smaller than the smallest diameter of the safety bolt within the drive square. This facilitates comparatively little weakening of the cross section of the drive square.

In one particularly preferred embodiment, the safety bolt has a rotationally symmetrical design. The safety bolt may have a tapering, with which the safety pin engages for the purpose of securing the safety bolt in the drive square.

In another preferred embodiment, the drive square has a groove shoulder on its end face for accommodating a retaining element, the retaining element fixing the safety pin in position in the accommodated state. It has proven to be advantageous if the retaining element is a retaining ring or a locking spring.

The safety bolt is preferably spring-mounted with the aid of a pressure spring, in particular a helical spring. The helical spring may be situated entirely within a recess, preferably within a blind hole of the drive square. This occurs preferably in both the compressed and the expanded state.

In one particularly advantageous refinement, a second safety pin, in particular precisely one second safety pin, is provided to secure the safety bolt against falling out. The second safety pin is preferably situated in parallel to the first safety pin. It has proven to be advantageous if the first and second safety pins are situated at a distance from each other on both sides of the safety bolt.

The first and second safety pins may be spaced a distance from each other, the distance corresponding to a width of a recess of the drive square designed to accommodate the safety bolt and/or the pressure spring.

With regard to the impact wrench, the present invention provides an impact wrench which includes a square tool holder described above for accommodating a tool, in particular an impact wrench socket.

BRIEF DESCRIPTION OF THE DRAWINGS

Other advantages result from the following description of the figures. One exemplary embodiment of the present invention is illustrated in the figures. The figures, the description and the claims contain numerous features in combination. Those skilled in the art will advantageously also consider the features individually and combine them to form other meaningful combinations.

In the figures, identical and equivalent components are provided with identical reference numerals.

DETAILED DESCRIPTION

Figure 1:
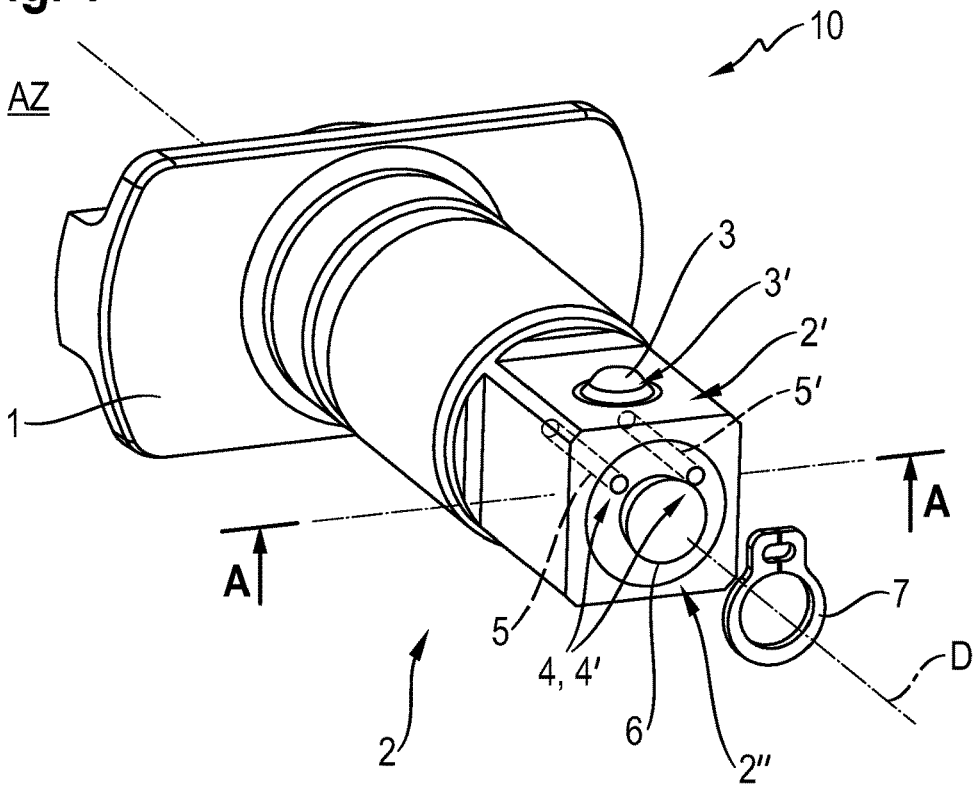
FIG. 1 shows a first exemplary embodiment of a square tool holder.

A square tool holder 10 in FIG. 1 includes an anvil 1, on which a drive square 2 is situated for accommodating a tool for example an impact wrench socket, shown schematically as 100 (FIG. 4), of an impact wrench 1000 (FIG. 4), also shown schematically. Square tool holder 10 includes a safety bolt 3 for securing purposes. Safety bolt 3 is mounted in drive square 2, movable perpendicularly to rotation axis D of anvil 1. Safety bolt 3 is spring-mounted in drive square 2 (cf. FIG. 4).

As is apparent from FIG. 1, safety bolt 3 has a hemispherical surface 3' in the present case. In the state of spring-extension AZ of safety bolt 3 illustrated in FIG. 1, hemispherical surface 3' of safety bolt 3 protrudes from a holding surface 2' of drive square 2. In the present case, a holding surface is understood to be, in particular, a surface on which a tool accommodated on the drive square is supported and via which driving forces are transferred to the tool.

Safety bolt 3 is secured against falling out by a first safety pin 4 and a second safety pin 4'. First safety pin 4 and second safety pin 4' extend in parallel to rotation axis D of the anvil. First safety pin 4 and second safety pin 4' are furthermore situated in particular blind holes 5, 5', which are indicated by the broken line in FIG. 1, since they run within drive square 2. Blind holes 5, 5' extend from an end face 2" of drive square 2 in parallel to rotation axis D of anvil 1. A surface normal of end face 2", which is not illustrated, runs in parallel to rotation axis D of anvil 1.

As is further apparent from FIG. 1, drive square 2 has a groove shoulder 6 on its end face 2". Groove shoulder 6 is used to accommodate a retaining element 7, which is provided for fixing the position of first safety pin 4 and second safety pin 4'. As is apparent from FIG. 1, retaining element 7 is provided as a retaining ring. In the exemplary embodiment illustrated in FIG. 1, retaining element 7 is not situated on groove shoulder 6, so that first safety pin 4 and second safety pin 4' may be easily removed or replaced.

Figure 2:
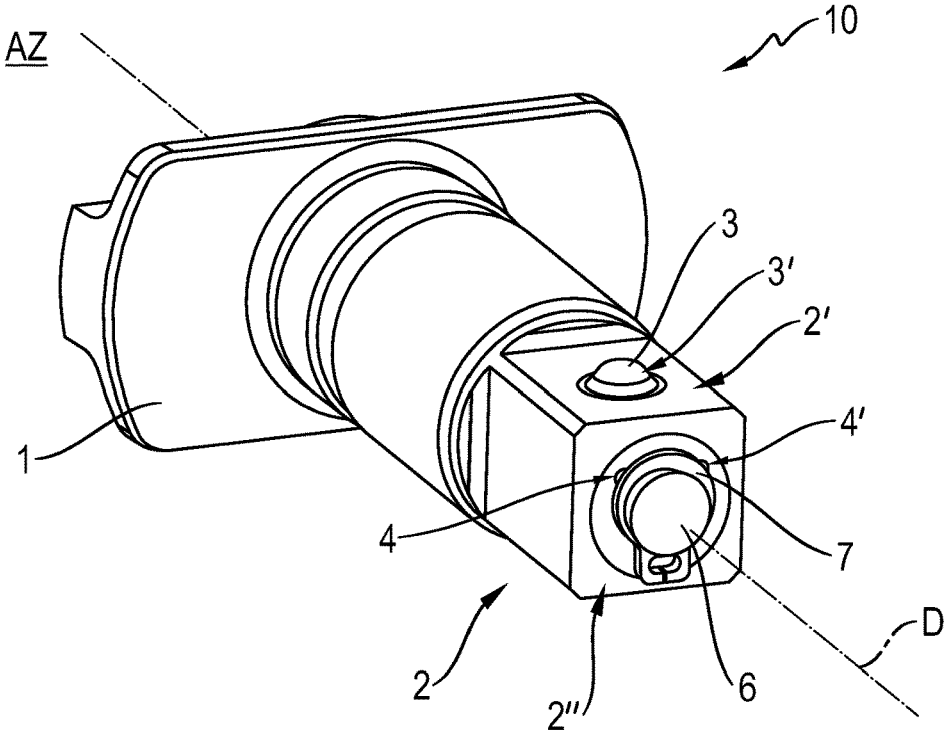
FIG. 2 shows the square tool holder from FIG. 1, including a situated retaining element.

FIG. 2 shows square tool holder 10 from FIG. 1, retaining element 7 being accommodated on groove shoulder 6. First safety pin 4 and second safety pin 4' are thus fixed in position. A tool, which is not illustrated here, for example an impact wrench socket, may be securely mounted on drive square 2.

Figure 3:
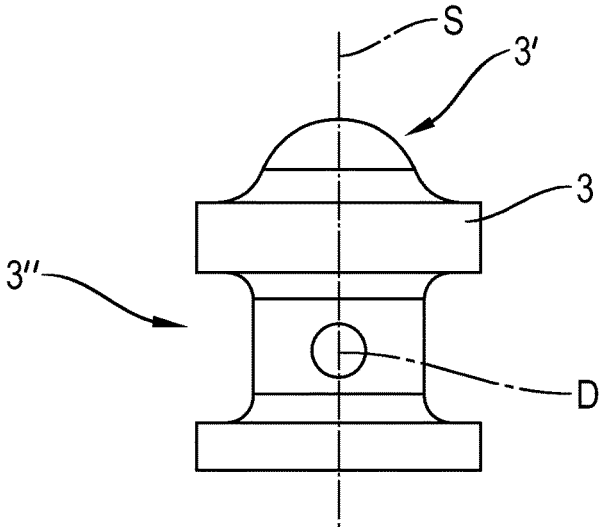
FIG. 3 show a safety bolt of a square tool holder according to the present invention.

FIG. 3 shows an example of a safety bolt 3 of a square tool holder, which is not illustrated here. Safety bolt 3 has a rotationally symmetrical design with respect to an axis of symmetry S of safety bolt 3. Rotation axis D of anvil 1 points into the paper plane of the page.

Hemispherical surface 3' of safety bolt 3, which facilitates a tool-free mounting of an impact wrench socket, is clearly apparent. Safety bolt 3 furthermore has a tapering 3", which extends around safety bolt 3 in the shape of a belt. Tapering 3" is used to accommodate the safety pins for the purpose of securing safety bolt 3 in a drive square (cf. FIG. 4).

Figure 4:
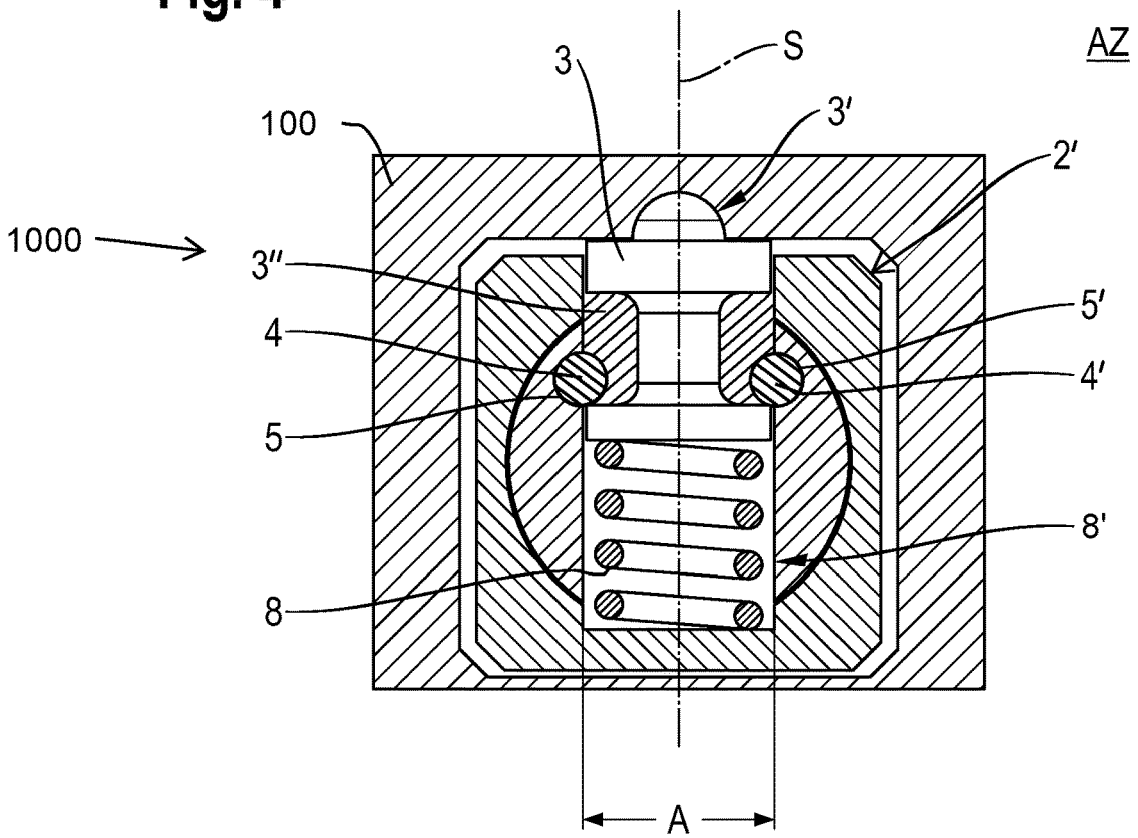
FIG. 4 shows a sectional representation of the square tool holder from FIGS. 1 and 2.

FIG. 4 shows a sectional representation of square tool holder 10 from FIG. 1 along section line A-A. Safety bolt 3 in FIG. 4 is in a state of spring-extension AZ, i.e., its hemispherical surface 3' protrudes from holding surface 2' of drive square 2. In the present case, only hemispherical surface 3' protrudes from holding surface 2'.

For the purpose of spring-mounting, safety bolt 3 is spring-mounted via a helical spring 8. Helical spring 8 is situated entirely in a corresponding recess 8' in drive square 2. The state of spring-extension AZ of safety bolt 3 illustrated in FIG. 4 is also the fully deflected state of safety bolt 3, which is secured against falling out by safety pins 4, 4' situated on both sides of safety bolt 3. Safety pins 4, 4' thus form both an effective means against falling out and a stop limit for safety bolt 3 in two positions along axis of symmetry S of safety bolt 3.

As is also apparent from FIG. 4, first and second safety pins 4, 4' are situated a distance from each other by a distance A. Distance A between first and second safety pins 4, 4' corresponds to the diameter of recess 8', in which both helical spring 8 and sections of safety bolt 3 are mounted.

A range of motion between the state of spring-extension AZ, which is illustrated in FIG. 4, and the state of spring-compression, which is not illustrated, is defined by the elongated extension of tapering 3' in parallel to axis of symmetry S of safety bolt 3. The surfaces left by tapering 3' on both sides in safety bolt 3 are used as a guide surface for guiding safety bolt 3 within recess 8' of drive square 2.

LIST OF REFERENCE NUMERALS

1 anvil
2 drive square
2' holding surface of the drive square
2" end face of the drive square
3 safety bolt
3' hemispherical surface of the safety bolt
3" tapering of the safety bolt
4 first safety pin
4' second safety pin
5 first blind hole
5' second blind hole
6 groove shoulder
7 retaining element
8 helical spring
8' recess
10 square tool holder
A distance
AZ state of spring-extension
D rotation axis of the anvil
S axis of symmetry of the safety bolt

The invention claimed is:

1. A square tool holder for an impact wrench, comprising:
an anvil, a drive square situated on the anvil for accommodating a tool, the anvil having a rotation axis;
a safety bolt for securing the accommodated tool, the safety bolt being spring-mounted in the drive square, movable perpendicularly to the rotation axis, the safety bolt having a rounded surface protruding from a holding surface of the drive square in a state of spring-extension of the safety bolt and being at least partially countersunk in the holding surface in a state of spring-compression of the safety bolt; and
a safety pin situated in the drive square, the safety bolt being secured against falling out by the safety pin; the drive square having a groove shoulder protruding axially from an end face for accommodating a retaining element, the retaining element fixing the position of the safety pin in the accommodated state.

2. The square tool holder as recited in claim 1 wherein the safety pin extends in parallel to the rotation axis of the anvil.

3. The square tool holder as recited in claim 2 wherein the safety pin is situated in a blind hole extending from an end face of the drive square in parallel to the rotation axis of the anvil.

4. The square tool holder as recited in claim 1 wherein the safety bolt has a rotationally symmetrical design and a tapering, the safety pin engaging with the tapering for securing the safety bolt in the drive square.

5. The square tool holder as recited in claim 1 wherein a diameter of the safety pin is smaller than a smallest diameter of the safety bolt within the drive square.

6. The square tool holder as recited in claim 1 wherein the retaining element is a retaining ring or a locking spring.

7. The square tool holder as recited in claim 1 wherein the safety bolt is spring-mounted with the aid of a pressure spring.

8. The square tool holder as recited in claim 7 wherein the pressure spring is a helical spring.

9. The square tool holder as recited in claim 1 further comprising a second safety pin for securing the safety bolt against falling out.

10. The square tool holder as recited in claim 9 wherein the second safety pin is situated in parallel to the first safety pin.

11. The square tool holder as recited in claim 1 wherein the tool is an impact wrench socket.

12. The square tool holder as recited in claim 1 wherein the rounded surface is a hemispherical surface.

13. An impact wrench comprising the square tool holder as recited in claim 1; and the tool.

14. The impact wrench as recited in claim 13 wherein the tool is an impact wrench socket.

15. The square tool holder as recited in claim 1 wherein the retaining element is a retaining ring.

16. The square tool holder as recited in claim 15 wherein the retaining ring is situated on the groove shoulder.

17. The square tool holder as recited in claim 15 wherein the retaining ring blocks an end of the safety pin.

18. The square tool holder as recited in claim 17 wherein the retaining ring blocks a further end of a further safety pin.

19. The square tool holder as recited in claim 1 wherein the groove shoulder is circular, and the retaining element is a retaining ring fitting around the protruding groove shoulder.

20. The square tool holder as recited in claim 1 wherein the safety pin extends in parallel to the rotation axis of the anvil, the safety pin is situated in a blind hole extending from an end face of the drive square in parallel to the rotation axis of the anvil, the groove shoulder being circular, and the retaining element being a retaining ring, the retaining ring fitting around the protruding groove shoulder to prevent the safety pin from moving out of the blind hole.

21. A square tool holder for an impact wrench, comprising:

an anvil, a drive square situated on the anvil for accommodating a tool, the anvil having a rotation axis;

a safety bolt for securing the accommodated tool, the safety bolt being spring-mounted in the drive square, movable perpendicularly to the rotation axis, the safety bolt having a rounded surface protruding from a holding surface of the drive square in a state of spring-extension of the safety bolt and being at least partially countersunk in the holding surface in a state of spring-compression of the safety bolt; and two safety pins situated in the drive square in blind holes extending from an end face of the drive square in parallel to the rotation axis of the anvil, the safety bolt being secured against falling out by the two safety pins; the drive square having a groove shoulder protruding axially from an end face for accommodating a retaining element, the retaining element being a retaining ring, the retaining ring fitting around the protruding groove shoulder to prevent the two safety pin from moving out of the blind holes.

22. The square tool holder as recited in claim 21 wherein the two safety pins are spaced by a distance, the safety bolt fitting between the two safety pins.

* * * * *